US007931449B2

(12) United States Patent
Fitton et al.

(10) Patent No.: US 7,931,449 B2
(45) Date of Patent: Apr. 26, 2011

(54) FAN

(75) Inventors: Nicholas Gerald Fitton, Wiltshire (GB); Frederic Nicolas, Wiltshire (GB); Peter David Gammack, Wiltshire (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 12/560,232

(22) Filed: Sep. 15, 2009

(65) Prior Publication Data

US 2010/0254800 A1 Oct. 7, 2010

(30) Foreign Application Priority Data

Sep. 23, 2008 (GB) ..... 0817362.7

(51) Int. Cl.
*F04B 23/08* (2006.01)
*F04F 5/44* (2006.01)

(52) U.S. Cl. ..... 417/84; 417/198

(58) Field of Classification Search ..... 239/265.17, 239/434.5, 561, 568, DIG. 7; 417/76, 84, 417/155, 177, 198
See application file for complete search history.

(56) References Cited

U.S. PATENT DOCUMENTS

| | | | |
|---|---|---|---|
| 1,767,060 | A | 6/1930 | Ferguson |
| 1,896,869 | A | 2/1933 | Larsh |
| 2,014,185 | A | 9/1935 | Martin |
| D103,476 | S | 3/1937 | Weber |
| 2,115,883 | A | 5/1938 | Sher |
| D115,344 | S | 6/1939 | Chapman |
| 2,210,458 | A | 8/1940 | Keilholtz |
| 2,336,295 | A | 12/1943 | Reimuller |
| 2,433,795 | A | 12/1947 | Stokes |
| 2,473,325 | A | 6/1949 | Aufiero |
| 2,488,467 | A | 11/1949 | De Lisio |
| 2,510,132 | A | 6/1950 | Morrison |
| 2,544,379 | A | 3/1951 | Davenport |
| 2,547,448 | A | 4/1951 | Demuth |
| 2,583,374 | A | 1/1952 | Hoffman |

(Continued)

FOREIGN PATENT DOCUMENTS

| | | |
|---|---|---|
| CH | 346643 | 5/1960 |

(Continued)

OTHER PUBLICATIONS

GB Search Report dated Jan. 20, 2009 directed at counterpart application No. 0817362.7; 1 page.

(Continued)

*Primary Examiner* — Devon C Kramer
*Assistant Examiner* — Bryan Lettman
(74) *Attorney, Agent, or Firm* — Morrison & Foerster LLP

(57) ABSTRACT

A bladeless fan assembly (100) for creating an air current comprises a nozzle (1) mounted on a base (16) housing for creating an air flow through the nozzle (1). The nozzle (1) comprises an interior passage (10) for receiving the air flow from the base (16) and a mouth (12) through which the air flow is emitted. The nozzle (1) extends about an axis to define an opening (2) through which air from outside the fan assembly (100) is drawn by the air flow emitted from the mouth (12). The nozzle (1) comprises a surface over which the mouth (12) is arranged to direct the air flow. The surface comprises a diffuser portion (46) tapering away from the axis, and a guide portion (48) downstream from the diffuser portion (46) and angled thereto.

16 Claims, 5 Drawing Sheets

U.S. PATENT DOCUMENTS

| | | | | |
|---|---|---|---|---|
| 2,620,127 | A | 12/1952 | Radcliffe | |
| 2,808,198 | A | 10/1957 | Morrison | |
| 2,830,779 | A | 4/1958 | Wentling | |
| 2,838,229 | A | 6/1958 | Belanger | |
| 2,922,570 | A | 1/1960 | Allen | |
| 3,270,655 | A | 9/1966 | Guirl et al. | |
| D206,973 | S | 2/1967 | De Lisio | |
| 3,503,138 | A | 3/1970 | Fuchs et al. | |
| 3,724,092 | A | 4/1973 | McCleerey | |
| 3,795,367 | A | 3/1974 | Mocarski | |
| 3,875,745 | A * | 4/1975 | Franklin | 60/319 |
| 3,885,891 | A | 5/1975 | Throndson | |
| 4,037,991 | A * | 7/1977 | Taylor | 417/80 |
| 4,046,492 | A | 9/1977 | Inglis | |
| 4,342,204 | A | 8/1982 | Melikian et al. | |
| 4,643,351 | A | 2/1987 | Fukamachi et al. | |
| 4,718,870 | A * | 1/1988 | Watts | 440/47 |
| 4,732,539 | A | 3/1988 | Shin-Chin | |
| 5,061,405 | A | 10/1991 | Stanek et al. | |
| 5,168,722 | A | 12/1992 | Brock | |
| 5,188,508 | A | 2/1993 | Scott et al. | |
| 5,425,902 | A | 6/1995 | Miller et al. | |
| 5,609,473 | A | 3/1997 | Litvin | |
| 5,881,685 | A | 3/1999 | Foss et al. | |
| D415,271 | S | 10/1999 | Feer | |
| 6,015,274 | A | 1/2000 | Bias et al. | |
| 6,073,881 | A | 6/2000 | Chen | |
| D429,808 | S | 8/2000 | Krauss et al. | |
| 6,123,618 | A | 9/2000 | Day | |
| D435,899 | S | 1/2001 | Melwani | |
| 6,254,337 | B1 | 7/2001 | Arnold | |
| 6,269,549 | B1 | 8/2001 | Carlucci et al. | |
| 6,282,746 | B1 | 9/2001 | Schleeter | |
| 6,293,121 | B1 | 9/2001 | Labrador | |
| 6,386,845 | B1 | 5/2002 | Bedard | |
| 6,480,672 | B1 | 11/2002 | Rosenzweig et al. | |
| D485,895 | S | 1/2004 | Melwani | |
| 7,147,336 | B1 | 12/2006 | Chou | |
| D539,414 | S | 3/2007 | Russak et al. | |
| D598,532 | S | 8/2009 | Dyson et al. | |
| D602,143 | S | 10/2009 | Gammack et al. | |
| D602,144 | S | 10/2009 | Dyson et al. | |
| D605,748 | S | 12/2009 | Gammack et al. | |
| 7,664,377 | B2 * | 2/2010 | Liao | 388/851 |
| D614,280 | S | 4/2010 | Dyson et al. | |
| 2003/0059307 | A1 | 3/2003 | Moreno et al. | |
| 2003/0171093 | A1 | 9/2003 | Gumucio Del Pozo | |
| 2004/0022631 | A1 | 2/2004 | Birdsell et al. | |
| 2004/0149881 | A1 | 8/2004 | Allen | |
| 2005/0031448 | A1 | 2/2005 | Lasko et al. | |
| 2005/0053465 | A1 | 3/2005 | Roach et al. | |
| 2006/0199515 | A1 | 9/2006 | Lasko et al. | |
| 2007/0166160 | A1 | 7/2007 | Russak et al. | |
| 2009/0026850 | A1 | 1/2009 | Fu | |
| 2009/0060710 | A1 | 3/2009 | Gammack et al. | |
| 2009/0060711 | A1 | 3/2009 | Gammack et al. | |
| 2010/0150699 | A1 | 6/2010 | Nicolas et al. | |
| 2010/0225012 | A1 | 9/2010 | Fitton et al. | |
| 2010/0226749 | A1 | 9/2010 | Gammack et al. | |
| 2010/0226750 | A1 | 9/2010 | Gammack | |
| 2010/0226751 | A1 | 9/2010 | Gammack et al. | |
| 2010/0226752 | A1 | 9/2010 | Gammack et al. | |
| 2010/0226753 | A1 | 9/2010 | Dyson et al. | |
| 2010/0226754 | A1 | 9/2010 | Hutton et al. | |
| 2010/0226758 | A1 | 9/2010 | Cookson et al. | |
| 2010/0226763 | A1 | 9/2010 | Gammack et al. | |
| 2010/0226764 | A1 | 9/2010 | Gammack et al. | |
| 2010/0226769 | A1 | 9/2010 | Helps | |
| 2010/0226771 | A1 | 9/2010 | Crawford et al. | |
| 2010/0226787 | A1 | 9/2010 | Gammack et al. | |
| 2010/0226797 | A1 | 9/2010 | Fitton et al. | |
| 2010/0226801 | A1 | 9/2010 | Gammack | |

FOREIGN PATENT DOCUMENTS

| | | |
|---|---|---|
| CN | 2111392 | 7/1992 |
| CN | 201349269 | 11/2009 |
| DE | 1 291 090 | 3/1969 |
| DE | 24 51 557 | 5/1976 |
| DE | 3644567 | 7/1988 |
| DE | 19510397 | 9/1996 |
| EP | 1 138 954 | 10/2001 |
| EP | 2 000 675 | 12/2008 |
| FR | 1033034 | 7/1953 |
| FR | 1119439 | 6/1956 |
| FR | 2794195 | 12/2000 |
| GB | 22235 | 6/1914 |
| GB | 383498 | 11/1932 |
| GB | 593828 | 10/1947 |
| GB | 633273 | 12/1949 |
| GB | 641622 | 8/1950 |
| GB | 661747 | 11/1951 |
| GB | 1067956 | 5/1967 |
| GB | 1262131 | 2/1972 |
| GB | 1265341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1501473 | 2/1978 |
| GB | 2 178 256 | 2/1987 |
| GB | 2185531 | 7/1987 |
| GB | 2 218 196 | 11/1989 |
| GB | 2236804 | 4/1991 |
| GB | 2242935 | 10/1991 |
| GB | 2 285 504 | 7/1995 |
| GB | 2 428 569 | 2/2007 |
| GB | 2 452 593 | 3/2009 |
| GB | 2452490 | 3/2009 |
| JP | 56-167897 | 12/1981 |
| JP | 57-157097 | 9/1982 |
| JP | 61-31830 | 2/1986 |
| JP | 61-116093 | 6/1986 |
| JP | 63-179198 | 7/1988 |
| JP | 1-138399 | 5/1989 |
| JP | 2-218890 | 8/1990 |
| JP | 4-366330 | 12/1992 |
| JP | 5-157093 | 6/1993 |
| JP | 5-263786 | 10/1993 |
| JP | 6-74190 | 3/1994 |
| JP | 6-147188 | 5/1994 |
| JP | 6-257591 | 9/1994 |
| JP | 7-190443 | 7/1995 |
| JP | 9-100800 | 4/1997 |
| JP | 2000-116179 | 4/2000 |
| JP | 2001-17358 | 1/2001 |
| JP | 2004-216221 | 8/2004 |
| JP | 2005-307985 | 11/2005 |
| JP | 2007-138763 | 6/2007 |
| JP | 2007-138789 | 6/2007 |
| JP | 2008-100204 | 5/2008 |
| WO | WO 90/13478 | 11/1990 |
| WO | WO-02/073096 | 9/2002 |
| WO | WO 03/058795 | 7/2003 |
| WO | WO-2005/050026 | 6/2005 |
| WO | WO 2005/057091 | 6/2005 |
| WO | WO 2007/024955 | 3/2007 |
| WO | WO 2007/048205 | 5/2007 |
| WO | WO 2008/014641 | 2/2008 |
| WO | WO-2008/024569 | 2/2008 |
| WO | WO-2009/030879 | 3/2009 |
| WO | WO-2009/030881 | 3/2009 |

OTHER PUBLICATIONS

International Search Report and Written Opinion, mailed Oct. 21, 2009, directed towards counterpart application PCT/GB2009/051045; 8 pages.

Reba, I. (1966).“Applications of the Coanda Effect,” Scientific American 214:84-92.

Gammack et al., U.S. Appl. No. 12/945,558, filed Nov. 12, 2010; 23 pages.

Gammack et al., U.S. Appl. No. 12/917,247, filed Nov. 1, 2010; 40 pages.

Gammack, P. et al., U.S. Office Action mailed Dec. 9, 2010, directed to U.S. Appl. No. 12/203,698; 10 pages.
Gammack, P. et al., U.S. Office Action mailed Dec. 9, 2010, directed to U.S. Appl. No. 12/716,781; 17 pages.
Gammack, P. et al., U.S. Office Action mailed Dec. 10, 2010, directed to U.S. Appl. No. 12/230,613; 12 pages.

* cited by examiner

FAN

The present invention relates to a fan assembly. In its preferred embodiment, the present invention relates to a domestic fan, such as a desk fan, for creating air circulation and air current in a room, in an office or other domestic environment.

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. Such fans are available in a variety of sizes and shapes. For example, a ceiling fan can be at least 1 m in diameter, and is usually mounted in a suspended manner from the ceiling to provide a downward flow of air to cool a room. On the other hand, desk fans are often around 30 cm in diameter, and are usually free standing and portable.

A disadvantage of this type of arrangement is that the forward flow of air current produced by the rotating blades of the fan is not felt uniformly by the user. This is due to variations across the blade surface or across the outward facing surface of the fan. Uneven or 'choppy' air flow can be felt as a series of pulses or blasts of air and can be noisy. A further disadvantage is that the cooling effect created by the fan diminishes with distance from the user and the user may not be situated at the location or distance where it is possible to feel the greatest cooling effect. This means that the fan must be placed in close proximity to the user in order for the user to receive the benefit of the fan.

Other types of fan are described in U.S. Pat. Nos. 2,488,467, 2,433,795 and JP 56-167897. The fan of U.S. Pat. No. 2,433,795 has spiral slots in a rotating shroud instead of fan blades. The circulator fan disclosed in U.S. Pat. No. 2,488,467 emits air flow from a series of nozzles and has a large base including a motor and a blower or fan for creating the air flow.

In a domestic environment it is desirable for appliances to be as small and compact as possible due to space restrictions. For example, the base of a fan placed on, or close to, a desk reduces the area available for paperwork, a computer or other office equipment. Often multiple appliances must be located in the same area, close to a power supply point, and in close proximity to other appliances for ease of connection.

The shape and structure of a fan at a desk not only reduces the working area available to a user but can block natural light (or light from artificial sources) from reaching the desk area. A well lit desk area is desirable for close work and for reading. In addition, a well lit area can reduce eye strain and the related health problems that may result from prolonged periods working in reduced light levels.

In addition, it is undesirable for parts of the appliance to project outwardly, both for safety reasons and because such parts can be difficult to clean.

The present invention seeks to provide an improved fan assembly which obviates disadvantages of the prior art.

In a first aspect the present invention provide a bladeless fan assembly for creating an air current, the fan assembly comprising means for creating an air flow and a nozzle comprising an interior passage for receiving the air flow and a mouth for emitting the air flow, the nozzle extending about an axis to define an opening through which air from outside the fan assembly is drawn by the air flow emitted from the mouth, the nozzle comprising a surface over which the mouth is arranged to direct the air flow, the surface comprising a diffuser portion tapering away from said axis and a guide portion downstream from the diffuser portion and angled thereto.

Advantageously, by this arrangement an air current is generated and a cooling effect is created without requiring a bladed fan. The bladeless arrangement leads to lower noise emissions due to the absence of the sound of a fan blade moving through the air, and a reduction in moving parts. The tapered diffuser portion enhances the amplification properties of the fan assembly whilst minimizing noise and frictional losses over the surface. The arrangement and angle of the guide portion result in the shaping or profiling of the divergent air flow exiting the opening. Advantageously, the mean velocity increases as the air flow passes over the guide portion, which increases the cooling effect felt by a user. Advantageously, the arrangement of the guide portion and the diffuser portion directs the air flow towards a user's location whilst maintaining a smooth, even output without the user feeling a 'choppy' flow. The invention provides a fan assembly delivering a suitable cooling effect that is directed and focused as compared to the air flow produced by prior art fans.

In the following description of fan assemblies, and, in particular a fan of the preferred embodiment, the term 'bladeless' is used to describe a fan assembly in which air flow is emitted or projected forward from the fan assembly without the use of moving blades. By this definition a bladeless fan assembly can be considered to have an output area or emission zone absent moving blades from which the air flow is directed towards a user or into a room. The output area of the bladeless fan assembly may be supplied with a primary air flow generated by one of a variety of different sources, such as pumps, generators, motors or other fluid transfer devices, and which may include a rotating device such as a motor rotor and/or a bladed impeller for generating the air flow. The generated primary air flow can pass from the room space or other environment outside the fan assembly through the interior passage to the nozzle, and then back out to the room space through the mouth of the nozzle.

Hence, the description of a fan assembly as bladeless is not intended to extend to the description of the power source and components such as motors that are required for secondary fan functions. Examples of secondary fan functions can include lighting, adjustment and oscillation of the fan assembly.

Preferably, the angle subtended between the diffuser portion and the axis is in the range from 7° to 20°, more preferably around 15°. This arrangement provides for efficient air flow generation. In a preferred embodiment the guide portion extends symmetrically about the axis. By this arrangement the guide portion creates a balanced, or uniform, output surface over which the air flow generated by the fan assembly is emitted. Preferably, the guide portion extends substantially cylindrically about the axis. This creates a region for guiding and directing the airflow output from all around the opening defined by the nozzle of the fan assembly. In addition the cylindrical arrangement creates an assembly with a nozzle that appears tidy and uniform. An uncluttered design is desirable and appeals to a user or customer.

Preferably the nozzle extends by a distance of at least 50 mm in the direction of the axis. Preferably the nozzle extends about the axis by a distance in the range from 300 to 180 mm. This provides options for emission of air over a range of different output areas and opening sizes, such as may be suitable for cooling the upper body and face of a user when working at a desk, for example. Preferably, the guide portion extends in the direction of the axis by a distance in the range from 5 to 60 mm, more preferably around 20 mm. This distance provides a suitable guide structure for directing and concentrating the air flow emitted from the fan assembly and for generating a suitable cooling effect. The preferred dimensions of the nozzle result in a compact arrangement while generating a suitable amount of air flow from the fan assembly for cooling a user.

The nozzle may comprise a Coanda surface located adjacent the mouth and over which the mouth is arranged to direct the air flow. A Coanda surface is a known type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment in which a primary air flow is directed over a Coanda surface. A description of the features of a Coanda surface, and the effect of fluid flow over a Coanda surface, can be found in articles such as Reba, Scientific American, Volume 214, June 1966 pages 84 to 92. Through use of a Coanda surface, an increased amount of air from outside the fan assembly is drawn through the opening by the air emitted from the mouth.

In the preferred embodiment an air flow is created through the nozzle of the fan assembly. In the following description this air flow will be referred to as primary air flow. The primary air flow is emitted from the mouth of the nozzle and preferably passes over a Coanda surface. The primary air flow entrains air surrounding the mouth of the nozzle, which acts as an air amplifier to supply both the primary air flow and the entrained air to the user. The entrained air will be referred to here as a secondary air flow. The secondary air flow is drawn from the room space, region or external environment surrounding the mouth of the nozzle and, by displacement, from other regions around the fan assembly, and passes predominantly through the opening defined by the nozzle. The primary air flow directed over the Coanda surface combined with the entrained secondary air flow equates to a total air flow emitted or projected forward from the opening defined by the nozzle. The total air flow is sufficient for the fan assembly to create an air current suitable for cooling. Preferably, the entrainment of air surrounding the mouth of the nozzle is such that the primary air flow is amplified by at least five times, more preferably by at least ten times, while a smooth overall output is maintained.

The air current emitted from the opening defined by the nozzle may have an approximately flat velocity profile across the diameter of the nozzle. Overall the flow rate and profile can be described as plug flow with some regions having a laminar or partial laminar flow. The air current delivered by the fan assembly to the user may have the benefit of being an air flow with low turbulence and with a more linear air flow profile than that provided by other prior art devices. Advantageously, the air flow from the fan can be projected forward from the opening and the area surrounding the mouth of the nozzle with a laminar flow that is experienced by the user as a superior cooling effect to that from a bladed fan. The laminar air flow with low turbulence may travel efficiently out from the point of emission and lose less energy and less velocity to turbulence than the air flow generated by prior art fans. An advantage for a user is that the cooling effect can be felt even at a distance and the overall efficiency of the fan increases. This means that the user can choose to site the fan some distance from a work area or desk and still be able to feel the cooling benefit of the fan.

Preferably the nozzle comprises a loop. The shape of the nozzle is not constrained by the requirement to include space for a bladed fan. In a preferred embodiment the nozzle is annular. By providing an annular nozzle the fan can potentially reach a broad area. In a further preferred embodiment the nozzle is at least partially circular. This arrangement can provide a variety of design options for the fan, increasing the choice available to a user or customer. Furthermore, in this arrangement the nozzle can be manufactured as a single piece, reducing the complexity of the fan assembly and thereby reducing manufacturing costs. Alternatively, the nozzle may comprise an inner casing section and an outer casing section which define the interior passage, the mouth and the opening. Each casing section may comprise a plurality of components or a single annular component.

In a preferred arrangement the nozzle comprises at least one wall defining the interior passage and the mouth, and the at least one wall comprises opposing surfaces defining the mouth. Preferably, said at least one wall comprises an inner wall and an outer wall, and wherein the mouth is defined between opposing surfaces of the inner wall and the outer wall. Preferably, the mouth has an outlet, and the spacing between the opposing surfaces at the outlet of the mouth is preferably in the range from 0.5 mm to 5 mm. By this arrangement a nozzle can be provided with the desired flow properties to guide the primary air flow over the surface and provide a relatively uniform, or close to uniform, total air flow reaching the user.

In the preferred fan assembly the means for creating an air flow through the nozzle comprises an impeller driven by a motor. This can provide a fan assembly with efficient air flow generation. The means for creating an air flow preferably comprises a DC brushless motor and a mixed flow impeller. This can avoid frictional losses and carbon debris from the brushes used in a traditional brushed motor. Reducing carbon debris and emissions is advantageous in a clean or pollutant sensitive environment such as a hospital or around those with allergies. While induction motors, which are generally used in bladed fans, also have no brushes, a DC brushless motor can provide a much wider range of operating speeds than an induction motor.

The nozzle may be rotatable or pivotable relative to a base portion, or other portion, of the fan assembly. This enables the nozzle to be directed towards or away from a user as required. The fan assembly may be desk, floor, wall or ceiling mountable. This can increase the portion of a room over which the user experiences cooling.

In a second aspect the present invention provides a nozzle for a bladeless fan assembly for creating an air current, the nozzle comprising an interior passage for receiving an air flow and a mouth for emitting the air flow, the nozzle extending about an axis to define an opening through which air from outside the fan assembly is drawn by the air flow emitted from the mouth, the nozzle comprising a surface over which the mouth is arranged to direct the air flow, the surface comprising a diffuser portion tapering away from said axis and a guide portion downstream from the diffuser portion and angled thereto.

Features described above in connection with the first aspect of the invention are equally applicable to the second aspect of the invention, and vice versa.

An embodiment of the invention will now be described with reference to the accompanying drawings, in which.

Figure 1:
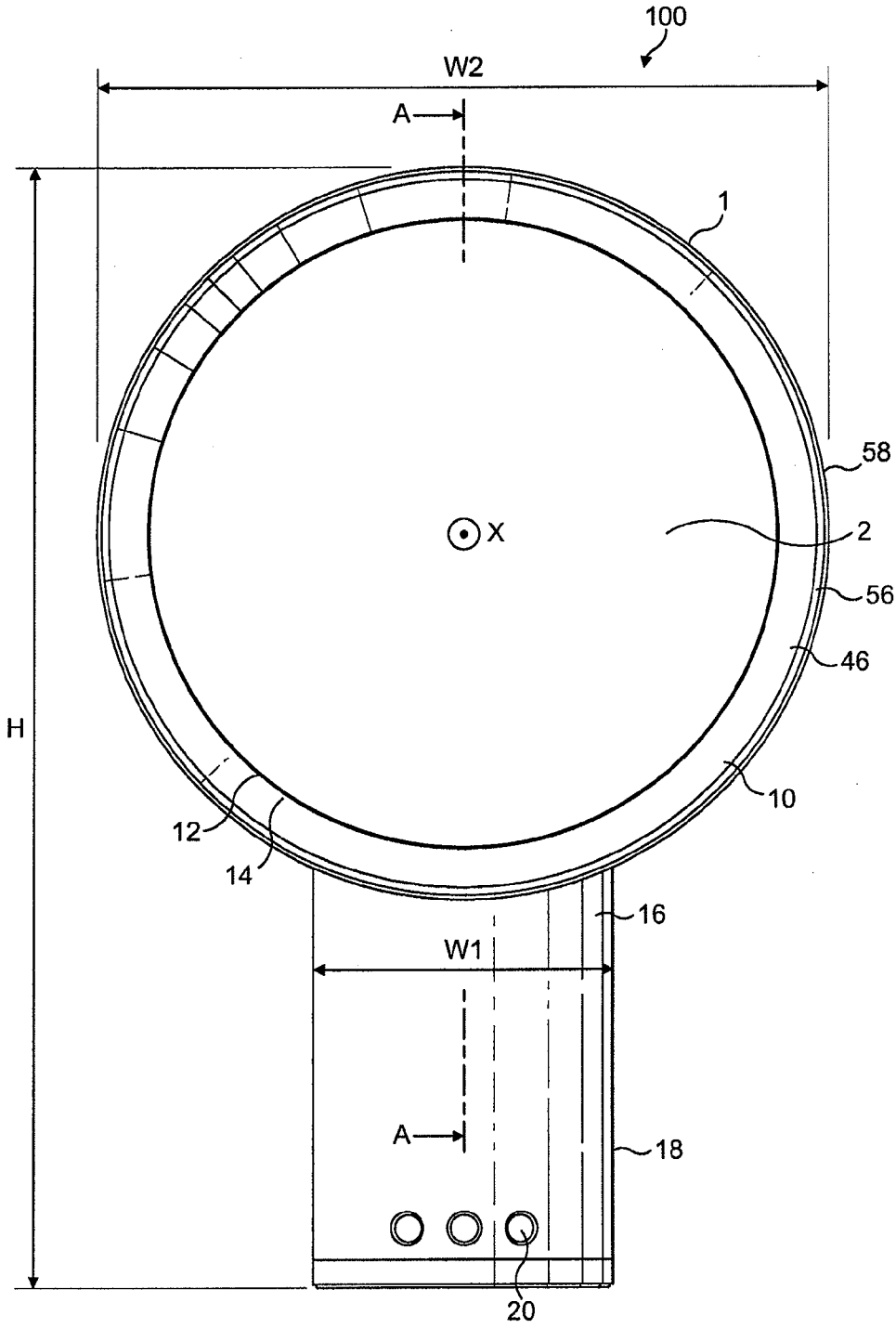
FIG. 1 is a front view of a fan assembly.
Figure 2:
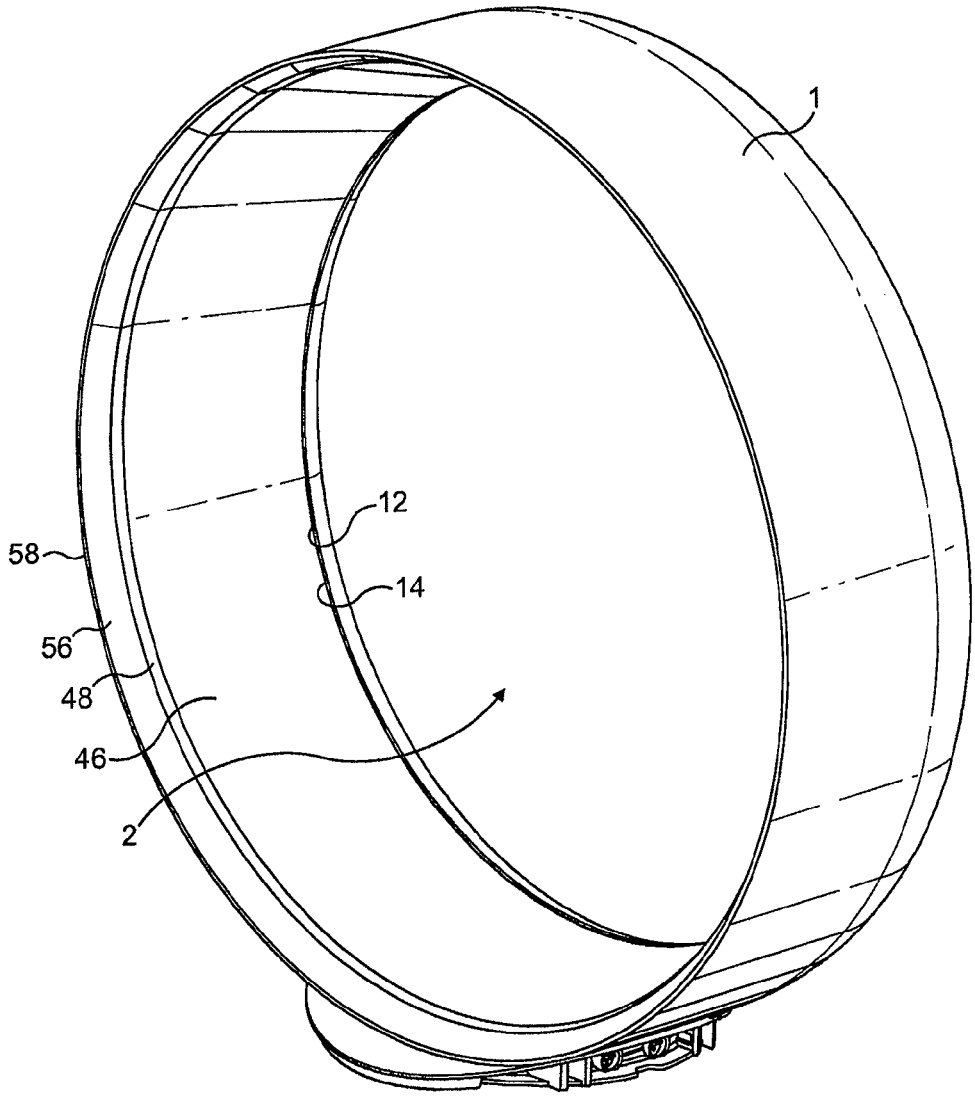
FIG. 2 is a perspective view of a portion of the fan assembly of FIG. 1.
Figure 3:
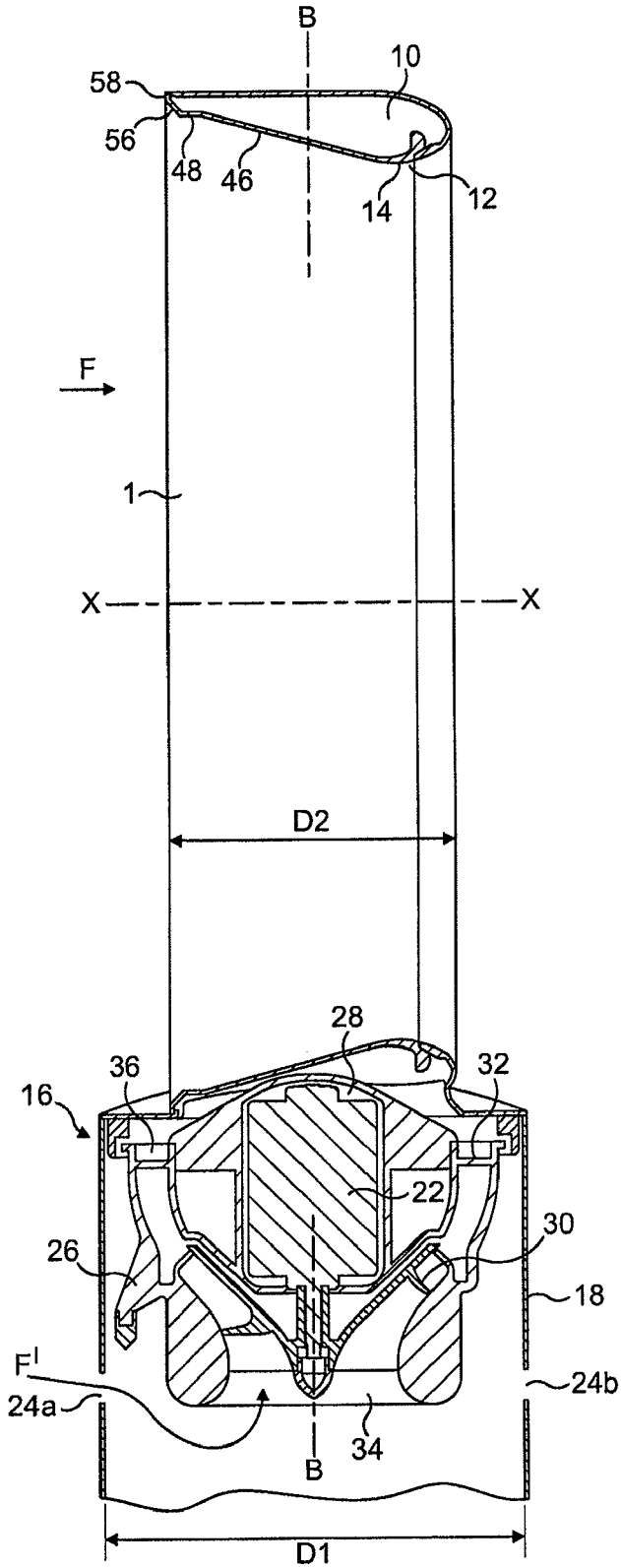
FIG. 3 is a side sectional view through a portion of the fan assembly of FIG. 1 taken at line A-A.

FIG. 1 illustrates an example of a fan assembly 100 viewed from the front of the device. The fan assembly 100 comprises an annular nozzle 1 defining a central opening 2. With reference also to FIGS. 2 and 3, the nozzle 1 comprises an interior passage 10, a mouth 12 and a Coanda surface 14 adjacent the mouth 12. The Coanda surface 14 is arranged so that a primary air flow exiting the mouth 12 and directed over the Coanda surface 14 is amplified by the Coanda effect. The nozzle 1 is connected to, and supported by, a base 16 having an outer casing 18. The base 16 includes a plurality of selection buttons 20 accessible through the outer casing 18 and through which the fan assembly 100 can be operated. The fan assembly has a height, H, width, W, and depth, D, shown on FIGS. 1 and 3. The nozzle 1 is arranged to extend substantially orthogonally about the axis X. The height of the fan assembly, H, is perpendicular to the axis X and extends from the end of the base 16 remote from the nozzle 1 to the end of the nozzle 1 remote from the base 16. In this embodiment the fan assembly 100 has a height, H, of around 530 mm, but the fan assembly 100 may have any desired height. The base 16 and the nozzle 1 have a width, W, perpendicular to the height H and perpendicular to the axis X. The width of the base 16 is shown labeled W1 and the width of the nozzle 1 is shown labeled as W2 on FIG. 1. The base 16 and the nozzle 1 have a depth in the direction of the axis X. The depth of the base 16 is shown labeled D1 and the depth of the nozzle 1 is shown labeled as D2 on FIG. 3.

Figure 4:
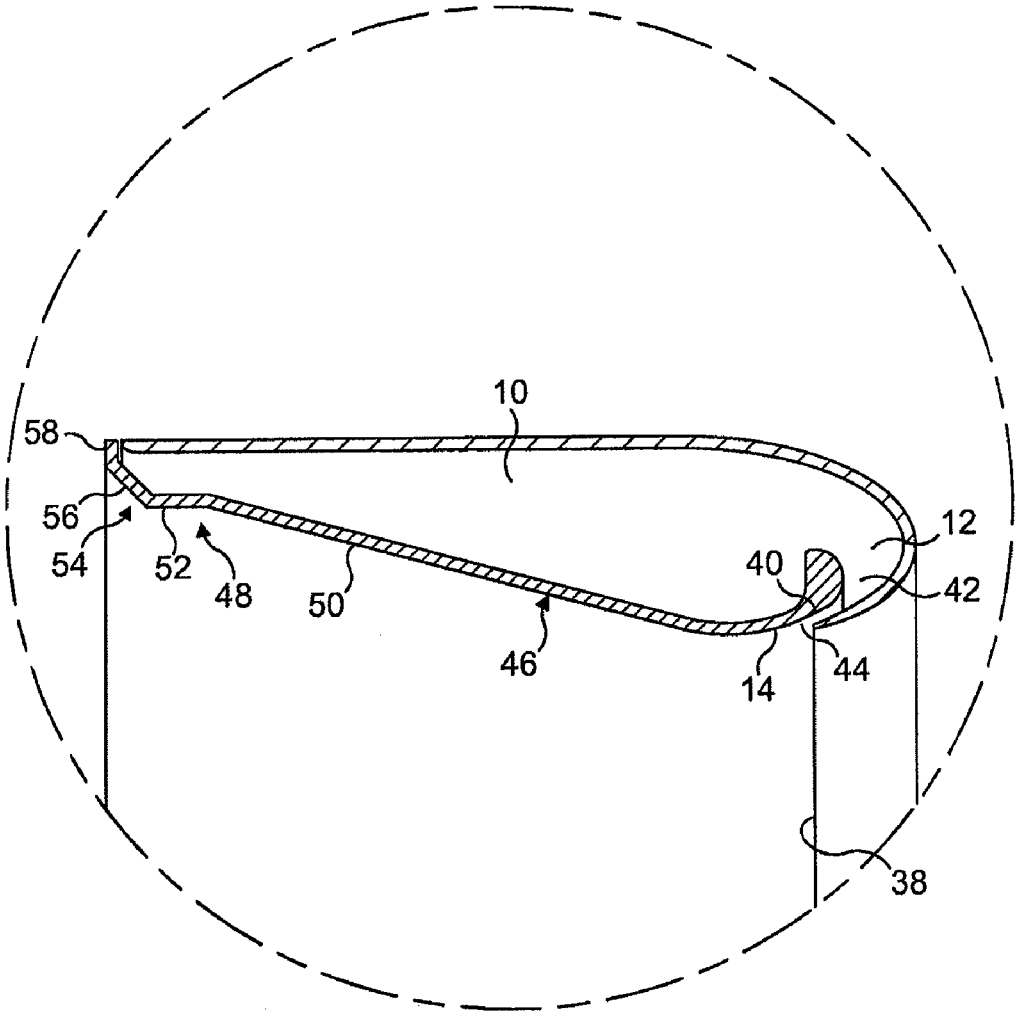
FIG. 4 is an enlarged side sectional detail of a portion of the fan assembly of FIG. 1.
Figure 5:
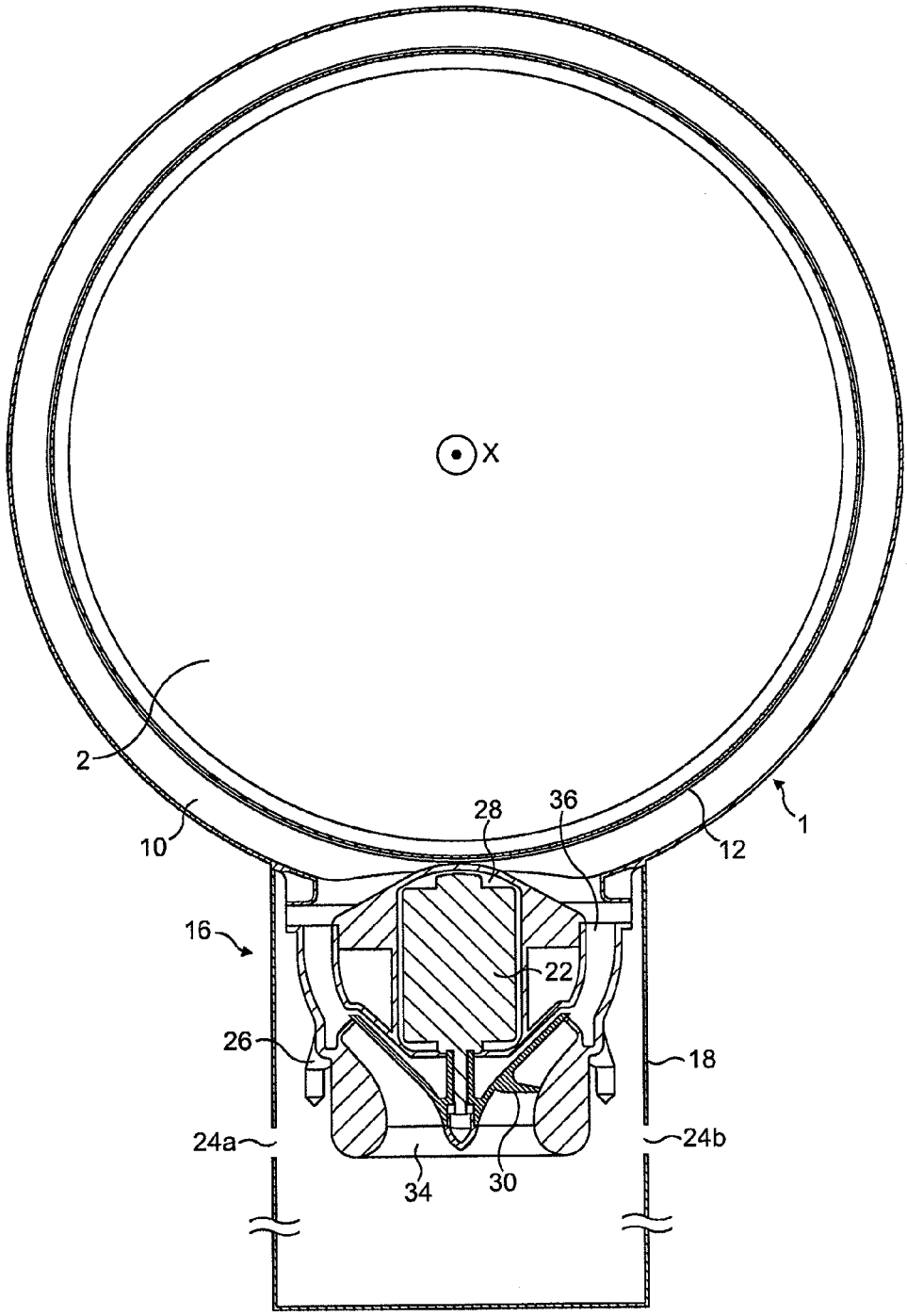
FIG. 5 is a sectional view of the fan assembly taken along line B-B of FIG. 3 and viewed from direction F of FIG. 3.

FIGS. 3, 4 and 5 illustrate further specific details of the fan assembly 100. A motor 22 for creating an air flow through the nozzle 1 is located inside the base 16. The base 16 is substantially cylindrical and in this embodiment the base 16 has a diameter (that is, a width W1 and a depth D1) of around 145 mm. The base 16 further comprises air inlets 24*a*, 24*b* formed in the outer casing 18. A motor housing 26 is located inside the base 16. The motor 22 is supported by the motor housing 26 and held in a secure position by a rubber mount or seal member 28.

In the illustrated embodiment, the motor 22 is a DC brushless motor. An impeller 30 is connected to a rotary shaft extending outwardly from the motor 22, and a diffuser 32 is positioned downstream of the impeller 30. The diffuser 32 comprises a fixed, stationary disc having spiral blades.

An inlet 34 to the impeller 30 communicates with the air inlets 24*a*, 24*b* formed in the outer casing 18 of the base 16. The outlet 36 of the diffuser 32 and the exhaust from the impeller 30 communicate with hollow passageway portions or ducts located inside the base 16 in order to establish air flow from the impeller 30 to the interior passage 10 of the nozzle 1. The motor 22 is connected to an electrical connection and power supply and is controlled by a controller (not shown). Communication between the controller and the plurality of selection buttons 20 enable a user to operate the fan assembly 100.

The features of the nozzle 1 will now be described with reference to FIGS. 3 and 4. The shape of the nozzle 1 is annular. In this embodiment the nozzle 1 has a diameter of around 350 mm, but the nozzle may have any desired diameter, for example around 300 mm. The interior passage 10 is annular and is formed as a continuous loop or duct within the nozzle 1. The nozzle 1 is formed from at least one wall defining the interior passage 10 and the mouth 12. In this embodiment the nozzle 1 comprises an inner wall 38 and an outer wall 40. In the illustrated embodiment the walls 38, 40 are arranged in a looped or folded shape such that the inner wall 38 and outer wall 40 approach one another. Opposing surfaces of the inner wall 38 and the outer wall 40 together define the mouth 12. The mouth 12 extends about the axis X. The mouth 12 comprises a tapered region 42 narrowing to an outlet 44. The outlet 44 comprises a gap or spacing formed between the inner wall 38 of the nozzle 1 and the outer wall 40 of the nozzle 1. The spacing between the opposing surfaces of the walls 38, 40 at the outlet 44 of the mouth 12 is chosen to be in the range from 0.5 mm to 5 mm. The choice of spacing will depend on the desired performance characteristics of the fan. In this embodiment the outlet 44 is around 1.3 mm wide, and the mouth 12 and the outlet 44 are concentric with the interior passage 10.

The mouth 12 is adjacent a surface comprising a Coanda surface 14. The surface of the nozzle 1 of the illustrated embodiment further comprises a diffuser portion 46 located downstream of the Coanda surface 14 and a guide portion 48 located downstream of the diffuser portion 46. The diffuser portion 46 comprises a diffuser surface 50 arranged to taper away from the axis X in such a way so as to assist the flow of air current delivered or output from the fan assembly 100. In the example illustrated in FIG. 3 the mouth 12 and the overall arrangement of the nozzle 1 is such that the angle subtended between the diffuser surface 50 and the axis X is around 15°. The angle is chosen for efficient air flow over the Coanda surface 14 and over the diffuser portion 46. The guide portion 48 includes a guide surface 52 arranged at an angle to the diffuser surface 50 in order to further aid efficient delivery of cooling air flow to a user. In the illustrated embodiment the guide surface 52 is arranged substantially parallel to the axis X and presents a substantially cylindrical and substantially smooth face to the air flow emitted from the mouth 12.

The surface of the nozzle 1 of the illustrated embodiment terminates at an outwardly flared surface 54 located downstream of the guide portion 48 and remote from the mouth 12. The flared surface 54 comprises a tapering portion 56 and a tip 58 defining the circular opening 2 from which air flow is emitted and projected from the fan assembly 1. The tapering portion 56 is arranged to taper away from the axis X in a manner such that the angle subtended between the tapering portion 56 and the axis is around 45°. The tapering portion 56 is arranged at an angle to the axis which is steeper than the angle subtended between the diffuser surface 50 and the axis. A sleek, tapered visual effect is achieved by the tapering portion 56 of the flared surface 54. The shape and blend of the flared surface 54 detracts from the relatively thick section of the nozzle 1 comprising the diffuser portion 46 and the guide portion 48. The user's eye is guided and led, by the tapering portion 56, in a direction outwards and away from axis X towards the tip 58. By this arrangement the appearance is of a fine, light, uncluttered design often favored by users or customers.

The nozzle 1 extends by a distance of around 50 mm in the direction of the axis. The diffuser portion 46 and the overall profile of the nozzle 1 are based, in part, on an aerofoil shape. In the example shown the diffuser portion 46 extends by a distance of around two thirds the overall depth of the nozzle 1 and the guide portion 48 extends by a distance of around one sixth the overall depth of the nozzle.

The fan assembly 100 described above operates in the following manner. When a user makes a suitable selection from the plurality of buttons 20 to operate or activate the fan assembly 100, a signal or other communication is sent to drive the motor 22. The motor 22 is thus activated and air is drawn into the fan assembly 100 via the air inlets 24*a*, 24*b*. In the preferred embodiment air is drawn in at a rate of approximately 20 to 30 liters per second, preferably around 27 l/s (liters per second). The air passes through the outer casing 18 and along the route illustrated by arrow F' of FIG. 3 to the inlet 34 of the impeller 30. The air flow leaving the outlet 36 of the diffuser 32 and the exhaust of the impeller 30 is divided into two air flows that proceed in opposite directions through the interior passage 10. The air flow is constricted as it enters the mouth 12 and is further constricted at the outlet 44 of the mouth 12. The constriction creates pressure in the system. The motor 22 creates an air flow through the nozzle 16 having a pressure of at least 400 kPa. The air flow thus created overcomes the pressure created by the constriction and the air flow exits through the outlet 44 as a primary air flow.

The output and emission of the primary air flow creates a low pressure area at the air inlets 24*a*, 24*b* with the effect of drawing additional air into the fan assembly 100. The operation of the fan assembly 100 induces high air flow through the nozzle 1 and out through the opening 2. The primary air flow is directed over the Coanda surface 14, the diffuser surface 50 and the guide surface 52. The primary air flow is concentrated or focused towards the user by the guide portion 48 and the angular arrangement of the guide surface 52 to the diffuser surface 50. A secondary air flow is generated by entrainment of air from the external environment, specifically from the region around the outlet 44 and from around the outer edge of the nozzle 1. A portion of the secondary air flow entrained by the primary air flow may also be guided over the diffuser surface 48. This secondary air flow passes through the opening 2, where it combines with the primary air flow to produce a total air flow projected forward from the nozzle 1.

The combination of entrainment and amplification results in a total air flow from the opening 2 of the fan assembly 100 that is greater than the air flow output from a fan assembly without such a Coanda or amplification surface adjacent the emission area.

The distribution and movement of the air flow over the diffuser portion 46 will now be described in terms of the fluid dynamics at the surface.

In general a diffuser functions to slow down the mean speed of a fluid, such as air. This is achieved by moving the air over an area or through a volume of controlled expansion. The divergent passageway or structure forming the space through which the fluid moves must allow the expansion or divergence experienced by the fluid to occur gradually. A harsh or rapid divergence will cause the air flow to be disrupted, causing vortices to form in the region of expansion. In this instance the air flow may become separated from the expansion surface and uneven flow will be generated. Vortices lead to an increase in turbulence, and associated noise, in the air flow which can be undesirable, particularly in a domestic product such as a fan.

In order to achieve a gradual divergence and gradually convert high speed air into lower speed air the diffuser can be geometrically divergent. In the arrangement described above, the structure of the diffuser portion 46 results in an avoidance of turbulence and vortex generation in the fan assembly.

The air flow passing over the diffuser surface 50 and beyond the diffuser portion 46 can tend to continue to diverge as it did through the passageway created by the diffuser portion 46. The influence of the guide portion 48 on the air flow is such that the air flow emitted or output from the fan opening is concentrated or focused towards user or into a room. The net result is an improved cooling effect at the user.

The combination of air flow amplification with the smooth divergence and concentration provided by the diffuser portion 46 and guide portion 48 results in a smooth, less turbulent output than that output from a fan assembly without such a diffuser portion 46 and guide portion 48.

The amplification and laminar type of air flow produced results in a sustained flow of air being directed towards a user from the nozzle 1. In the preferred embodiment the mass flow rate of air projected from the fan assembly 100 is at least 450 l/s, preferably in the range from 600 l/s to 700 l/s. The flow rate at a distance of up to 3 nozzle diameters (i.e. around 1000 to 1200 mm) from a user is around 400 to 500 l/s. The total air flow has a velocity of around 3 to 4 m/s (meters per second). Higher velocities are achievable by reducing the angle subtended between the surface and the axis X. A smaller angle results in the total air flow being emitted in a more focused and directed manner. This type of air flow tends to be emitted at a higher velocity but with a reduced mass flow rate. Conversely, greater mass flow can be achieved by increasing the angle between the surface and the axis. In this case the velocity of the emitted air flow is reduced but the mass flow generated increases. Thus the performance of the fan assembly can be altered by altering the angle subtended between the surface and the axis X.

The invention is not limited to the detailed description given above. Variations will be apparent to the person skilled in the art. For example, the fan could be of a different height or diameter. The base and the nozzle of the fan could be of a different depth, width and height. The fan need not be located on a desk, but could be free standing, wall mounted or ceiling mounted. The fan shape could be adapted to suit any kind of situation or location where a cooling flow of air is desired. A portable fan could have a smaller nozzle, say 5 cm in diameter. The means for creating an air flow through the nozzle can be a motor or other air emitting device, such as any air blower or vacuum source that can be used so that the fan assembly can create an air current in a room. Examples include a motor such as an AC induction motor or types of DC brushless motor, but may also comprise any suitable air movement or air transport device such as a pump or other means of providing directed fluid flow to generate and create an air flow. Features of a motor may include a diffuser or a secondary diffuser located downstream of the motor to recover some of the static pressure lost in the motor housing and through the motor.

The outlet of the mouth may be modified. The outlet of the mouth may be widened or narrowed to a variety of spacings to maximize air flow. The air flow emitted by the mouth may pass over a surface, such as Coanda surface, alternatively the airflow may be emitted through the mouth and be projected forward from the fan assembly without passing over an adjacent surface. The Coanda effect may be made to occur over a number of different surfaces, or a number of internal or external designs may be used in combination to achieve the flow and entrainment required. The diffuser portion may be comprised of a variety of diffuser lengths and structures. The guide portion may be a variety of lengths and be arranged at a number of different positions and orientations to as required for different fan requirements and different types of fan performance. The effect of directing or concentrating the effect of the airflow can be achieved in a number of different ways; for example the guide portion may have a shaped surface or be angled away from or towards the center of the nozzle and the axis X.

Other shapes of nozzle are envisaged. For example, a nozzle comprising an oval, or 'racetrack' shape, a single strip or line, or block shape could be used. The fan assembly provides access to the central part of the fan as there are no blades. This means that additional features such as lighting or a clock or LCD display could be provided in the opening defined by the nozzle.

Other features could include a pivotable or tiltable base for ease of movement and adjustment of the position of the nozzle for the user.

The invention claimed is:

1. A bladeless fan assembly for creating an air current, the fan assembly comprising:

a nozzle mounted on a base housing, and a device for creating an air flow through the nozzle, the nozzle comprising, an interior passage for receiving the air flow from the base housing, and a mouth through which the air flow is emitted, the nozzle extending about an axis to define an opening through which air from outside the fan assembly is drawn by the air flow emitted from the mouth, the nozzle further comprising a surface over which the mouth is arranged to direct the air flow, the surface comprising, a diffuser portion tapering away from said axis, a guide portion downstream from the diffuser portion and angled inwardly relative thereto, and a tapering portion downstream from the guide portion and angled outwardly relative thereto.

2. The fan assembly of claim 1, wherein the angle subtended between the diffuser portion and the axis is in the range from 7° to 20°.

3. The fan assembly of claim 1, wherein the guide portion extends substantially cylindrically about the axis.

4. The fan assembly of claim 1, wherein the nozzle extends by a distance of at least 5 cm in the direction of the axis.

5. The fan assembly of claim 1, wherein the nozzle extends about the axis by a distance in the range from 30 cm to 180 cm.

6. The fan assembly of claim 1, wherein the guide portion extends symmetrically about the axis.

7. The fan assembly of claim 1, wherein the guide portion extends in the direction of the axis by a distance in the range from 5 mm to 60 mm.

8. The fan assembly of claim 1, wherein the nozzle comprises a loop.

9. The fan assembly of claim 1, wherein the nozzle is substantially annular.

10. The fan assembly of claim 1, wherein the nozzle is at least partially circular.

11. The fan assembly of claim 1, wherein the nozzle comprises at least one wall defining the interior passage and the mouth, and wherein said at least one wall comprises opposing surfaces defining the mouth.

12. The fan assembly of claim 11, wherein the mouth has an outlet, and the spacing between the opposing surfaces at the outlet of the mouth is in the range from 1 mm to 5 mm.

13. The fan assembly of claim 1, wherein the device for creating an air flow through the nozzle comprises an impeller driven by a motor.

14. The fan assembly of claim 13, wherein the device for creating an air flow comprises a DC brushless motor and a mixed flow impeller.

15. The fan assembly of claim 1, wherein the angle subtended between the diffuser portion and the axis is approximately 15°.

16. The fan assembly of claim 1, wherein the guide portion extends in the direction of the axis by a distance of approximately 20 mm.

* * * * *